US011745251B2

(12) United States Patent
Dillon et al.

(10) Patent No.: US 11,745,251 B2
(45) Date of Patent: Sep. 5, 2023

(54) MULTIPLE ANVIL FIXTURE AND METHOD OF USE

(71) Applicant: Symmetry Medical Manufacturing, Inc, Warsaw, IN (US)

(72) Inventors: Richard Dillon, Manchester, NH (US); Jason Hawkes, Weare, NH (US)

(73) Assignee: SYMMETRY MEDICAL MANUFACTURING, INC, Warsaw, IN (US)

( * ) Notice: Subject to any disclaimer, the term of this patent is extended or adjusted under 35 U.S.C. 154(b) by 97 days.

(21) Appl. No.: 17/232,718

(22) Filed: Apr. 16, 2021

(65) Prior Publication Data

US 2021/0323048 A1 Oct. 21, 2021

Related U.S. Application Data

(60) Provisional application No. 63/010,963, filed on Apr. 16, 2020.

(51) Int. Cl.

| | |
|---|---|
| ***B21J 15/42*** | (2006.01) |
| ***B21J 15/36*** | (2006.01) |
| ***B21J 15/44*** | (2006.01) |
| ***B21J 15/14*** | (2006.01) |
| ***B21J 15/04*** | (2006.01) |

(52) U.S. Cl.

CPC ..... *B21J 15/44* (2013.01); *B21J 15/04* (2013.01); *B21J 15/14* (2013.01); *B21J 15/36* (2013.01); *B21J 15/42* (2013.01)

(58) Field of Classification Search

CPC ... B21J 15/36; B21J 15/04; B21J 15/14; B21J 15/42; B21J 15/44; B21J 15/10; B21J 15/147; B21J 15/38; B21J 19/04; B21J 15/00; B21J 15/02; B21J 15/142; B21J 15/145; B21J 15/30; B21J 15/365; B29C 65/601; B29C 65/602; B29C 65/606; B29C 65/607; F16B 5/04; F16B 5/045; Y10T 29/5377

USPC ..... 72/466.4, 466.5, 466.9; 29/525.05–525.07

See application file for complete search history.

(56) References Cited

U.S. PATENT DOCUMENTS

| | | | | | |
|---|---|---|---|---|---|
| 4,312,107 | A * | 1/1982 | White | B21J 15/14 | 29/233 |
| 6,121,781 | A * | 9/2000 | Martinez | B21J 15/142 | 324/661 |
| 2014/0182103 | A1 * | 7/2014 | Li | B21J 15/36 | 29/243.54 |

FOREIGN PATENT DOCUMENTS

| | | | | |
|---|---|---|---|---|
| DE | 19632238 A1 * | 2/1998 | B21J 15/02 | |
| KR | 101245795 B1 * | 3/2013 | B21J 15/28 | |
| KR | 20160110850 A * | 9/2016 | B21J 15/02 | |

* cited by examiner

*Primary Examiner* — Shelley M Self
*Assistant Examiner* — Jared O Brown
(74) *Attorney, Agent, or Firm* — Hayes Soloway PC

(57) ABSTRACT

A multiple anvil fixture possesses multiple anvils engaged to a base in a fixed relation to each other with the anvils oriented in a common direction. Each of the anvils includes a first structure and a second structure. The first structure and the second structure are slidably engaged. Each of the anvils has an extended position and a recoiled position and a biasing-element to bias the first structure and the second structure in the extended position. The multiple anvil structure can be used to rivet brackets onto containers. The anvil protrudes through the container in the extended position to help align holes in the feet of the brackets with openings in the container. The anvil then recoils beneath the container to serve for the fixation of rivets.

12 Claims, 7 Drawing Sheets

MULTIPLE ANVIL FIXTURE AND METHOD OF USE

CROSS-REFERENCE TO RELATED APPLICATIONS AND PRIORITY

This Patent Application Claims Priority from U.S. Provisional Patent Application No. 63/010,963 filed Apr. 16, 2020. This Patent Application is Herein Incorporated by Reference in its Entirety.

FIELD OF THE INVENTION

The present application generally relates to a multiple anvil fixture system, and more particularly, to multiple anvil fixture for applying rivets to a device in a fixed pattern.

BACKGROUND OF THE INVENTION

Manufacturing of containers with brackets via rivet application had long been a tedious application. Manually-operated stationary machines have been developed for riveting onto flat surfaces or containers with shallow walls. Containers with sidewalls greater than a couple of inches create clearance problems for many riveting machines. Frequently, when riveting small batches of product, the user must place an opening over the anvil by hand, set a bracket in place, compress the rivet, and then position another opening over the anvil for the next application. A need exists for a machine that can more effectively rivet in multiple locations within a container.

SUMMARY

A multiple anvil fixture is described wherein multiple anvils are engaged to a base in a fixed relation to each other, wherein the anvils are oriented in the same direction. In one exemplary embodiment the multiple anvil fixture includes a plurality of anvils wherein the anvils each comprise a first structure and a second structure, wherein the first structure and the second structure are slidably engageable. Each of the anvils is independently capable of being moved into an extended position and a recoiled position. A biasing-element biases the first structure in the extended position.

In a further exemplary embodiment the second structure comprises a hollow section and a base section wherein the biasing-element is fixed between the base section and a proximate end of the first section. In an embodiment the biasing element is one of a spring, an elastic member, and a set of magnets.

In another embodiment the hollow section comprises a stop on an inner wall wherein the stop extends inward into the slidable path of the first structure, such that the slidable path is shorter than the first structure.

In another embodiment the first structure comprises a first diameter, and the second structure comprises a second diameter, such that the first diameter is smaller than the second diameter.

In a further embodiment the first structure comprises a first lip having a first lip diameter wherein the first lip diameter is larger than the first diameter and wherein the first lip is contained by a distal end of the second structure. In a further embodiment the distal end has an opening wherein the opening is smaller than the second diameter, and larger than the first diameter.

In another embodiment the multiple anvil fixture comprises a plate wherein the plate comprises a plurality of holes such that each of the plurality of anvils protrude through one of the corresponding plurality of holes. In a further embodiment the plate comprises protrusions near each of the plurality of holes wherein the plurality of anvils extends through the hole in both the recoiled and extended positions.

In a further embodiment a method for making a container using the multiple anvil fixture wherein a plurality of anvils are placed in a fixed relation to each other, placing the plurality of anvils through a plurality of holes in a container, placing a rivet on one of the plurality of anvils, wherein the rivet goes through a bracket opening, and a hole in the container, compressing the rivet against the anvil wherein the anvil moves to the recoiled position. In the recoiled position the anvil deforms a bottom hollow portion of the rivet such that the bottom of the rivet is larger than the hole in the container, thereby fixing the bracket to the container.

In a further embodiment the container is a sterilization tray.

In a further embodiment the position of the plurality of anvils on the multiple anvil fixture correspond to a location wherein each of the locations receive a rivet and a bracket. In a further embodiment the positions of the brackets correspond to a design of a sterilization tray.

In another embodiment the rivet has a top and a shaft, wherein the top rests on the bracket, and the shaft goes through the bracket opening and the hole in the container.

In another embodiment the container can rest on a plate, wherein the plate comprises plate holes, and the plate is supported by the second structure of the anvil. The first structure of the anvil protrudes though the plate in both the extended position and the recoiled position. In a further embodiment the plate comprises protrusions near the openings, wherein the container rests on the protrusions.

DETAILED DESCRIPTION OF THE DRAWINGS

Figure 1A:
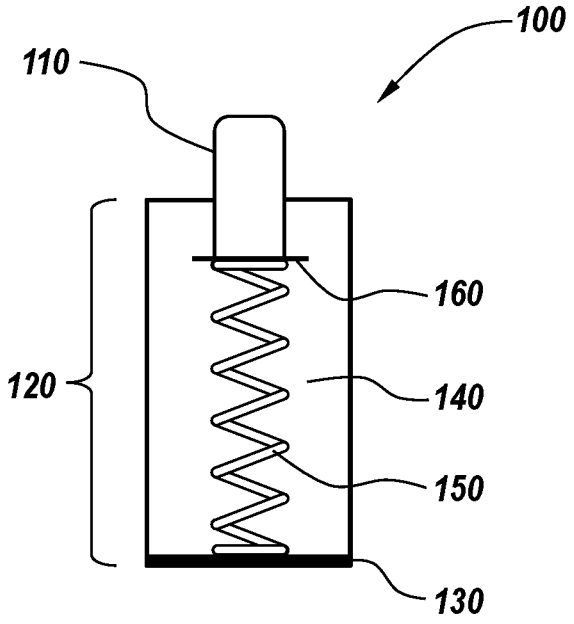
FIG. 1A is a cross-section illustration of an anvil in an extended position.

FIG. 1A is a cross-section illustration of an exemplary anvil 100 used in a multiple anvil fixture. The anvil 100 has a first structure 110, and a second structure 120, wherein the first structure 110 is slidably engaged with the second structure 120. The first structure 110 can be of a geometric shape that conforms to an interior of the second structure 120 with a smaller cross-sectional area to allow the first structure 110 to be slidable engaged with the second structure 120. In another embodiment the structures can have varying geometries, such that the first structure 110 can be received within the second structure 120. Although FIG. 1A depicts two structures, three or more structures could be used.

Figure 1B:
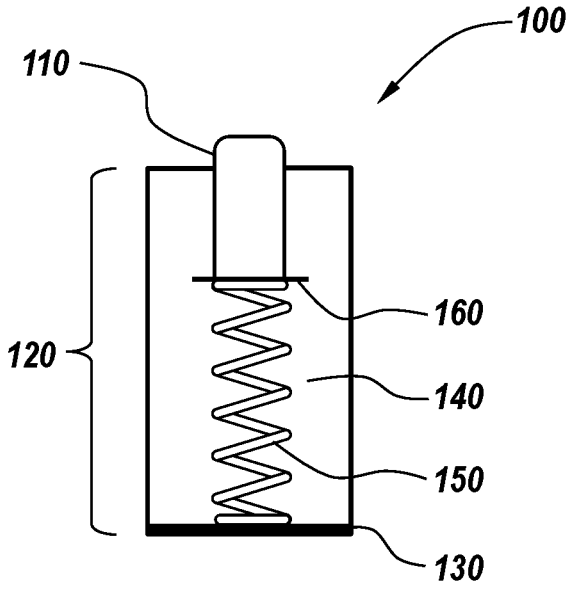
FIG. 1B is a cross-section illustration of the anvil illustrated in FIG. 1 in a recoiled position.

FIG. 1A illustrates the anvil 100 is an extended position wherein the first structure 110 is protruding from the second structure 120. As illustrated in FIG. 1B the anvil 100 can also be moved to a recoiled position wherein a majority of the first structure 110 is contained within the second structure 120. In the recoiled position, a part of the first portion 110 still protrudes above the second structure 120.

In some embodiments the second structure 120 has a hollow portion 140 and a base section 130. The anvil 100 comprises a biasing-element 150 abutting a proximate end 160 of the first section 110 and the base section 130 of the second structure 120. However, the biasing-element 150, could also be attached to another part of the second structure 120. The biasing-element 150 depicted in FIGS. 1A and 1B is a spring. The biasing-element 150 can be any acceptable biasing-element known to one having ordinary skill in the art, for example a set of magnets, or an elastic member.

Figure 2A:
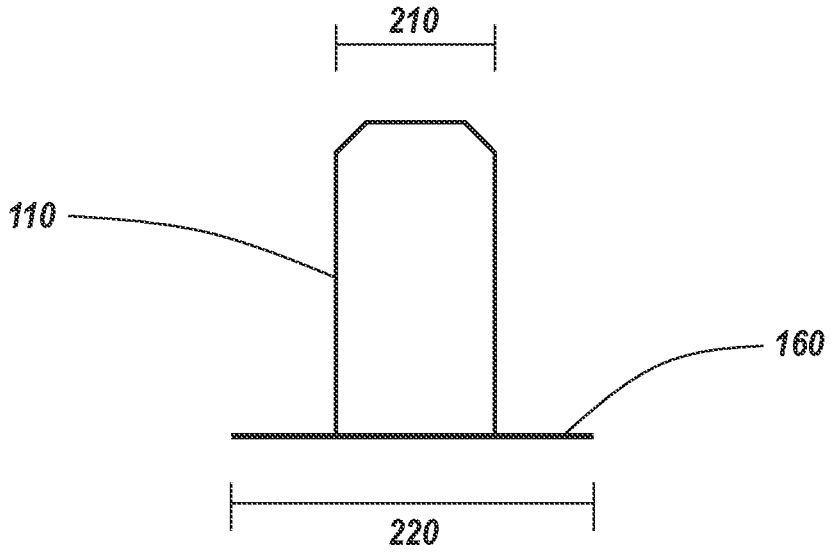
FIG. 2A is an illustration of a side view of a first structure of the anvil illustrated in FIG. 1.

FIG. 2A illustrates a view of the first structure 110. The body of the first structure 110 may have a first diameter 210, and the proximate end 160 may have a surface diameter 220. Although "diameter" is used in this example a diameter could be any distance across a shape. In some embodiments the first structure 110 is a solid body, and in others the first structure has a solid outer layer with a hollow center. The first structure 110 can be a uniform shape all the way though or have a thinning diameter at the top portion. The proximate end 160 has a thickness as to prevent disfiguration of the anvil 100. The first structure 110 can be made of any hard metal, or any metal which is harder than a rivet. Although some configurations have been described other configurations are available.

Figure 2B:
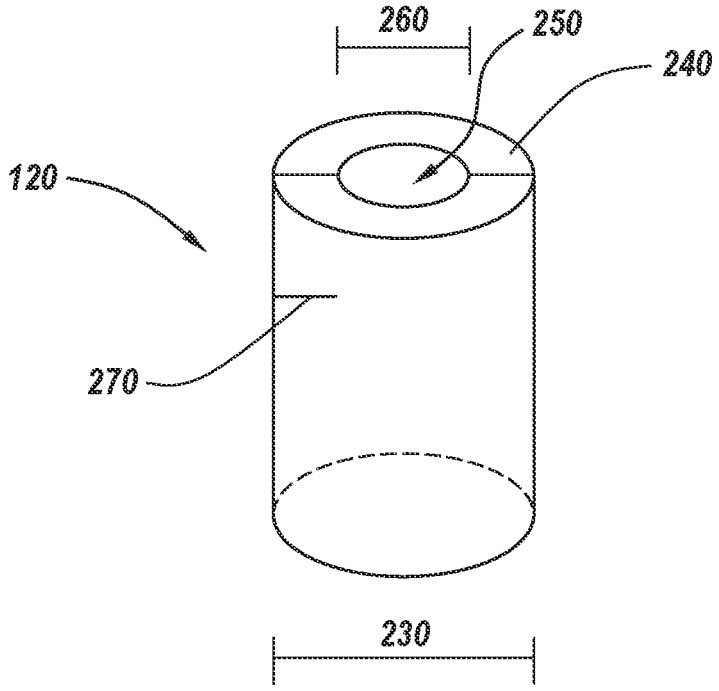
FIG. 2B is an illustration of a perspective view of a second structure of the anvil illustrated in FIG. 1.

FIG. 2B illustrates the second structure 120 having a second diameter 230. In the present embodiment the first diameter 210 is smaller than the second diameter 230. The distal end 240 of the second structure 120, comprises an opening 250 having an opening diameter 260 larger than the first diameter 210 and smaller than the second diameter 230.

The proximate end 160 of the first structure 110 is confined in the second structure 120 by the distal end 240. The proximate end 160 has a surface diameter 220 larger than the opening diameter 260. When the anvil 100 is in the extended position the proximate end 160, and the distal end 240 abut. In the recoiled position, the proximate end 160 and the distal end 240 are located a distance apart wherein the proximate end 160 is within the second structure 120. The proximate end 160 and the rest of the first structure 110 is resilient enough to avoid material deformation when used for repeated fixation of rivets. The resiliency requirement may inform material choices and dimensions of the first structure 110.

In some embodiments the second structure may include a stop 270 within the hollow section 140. The stop 270 can extend inward into a slidable path of the first structure 110. The stop 270 is located such that the slidable path of the first structure 110 is shorter than the height of the first structure 110. This position of the stop 270 prevents the first structure 110 from becoming lodged or struck within the second structure 120. Further when the proximate end 160 of the first structure 110 is in contact with the stop 270, the anvil is in the recoiled position. The stop 270 provides some rigidity to the recoiled position that is beneficial to fixation of the rivet.

In some embodiments the stop 270 is an extension into the hollow section 140. In other embodiments the stop 270 is a continuous narrowed inner circumference of the second structure 120, while in other embodiments the stop 270 is not continuous and on a fraction of the inner circumference of the second structure 120. In some embodiments the stop 270 can be an inward thickening of the wall such that the stop 270 extends for a height of the second structure 120. In other embodiments the walls of the second structure 120 gradually thicken forming a slant. In some embodiments the second structure 120 is made from the same material as the first structure 110, and in others the second structure 120 is made from a different material.

Figure 3:
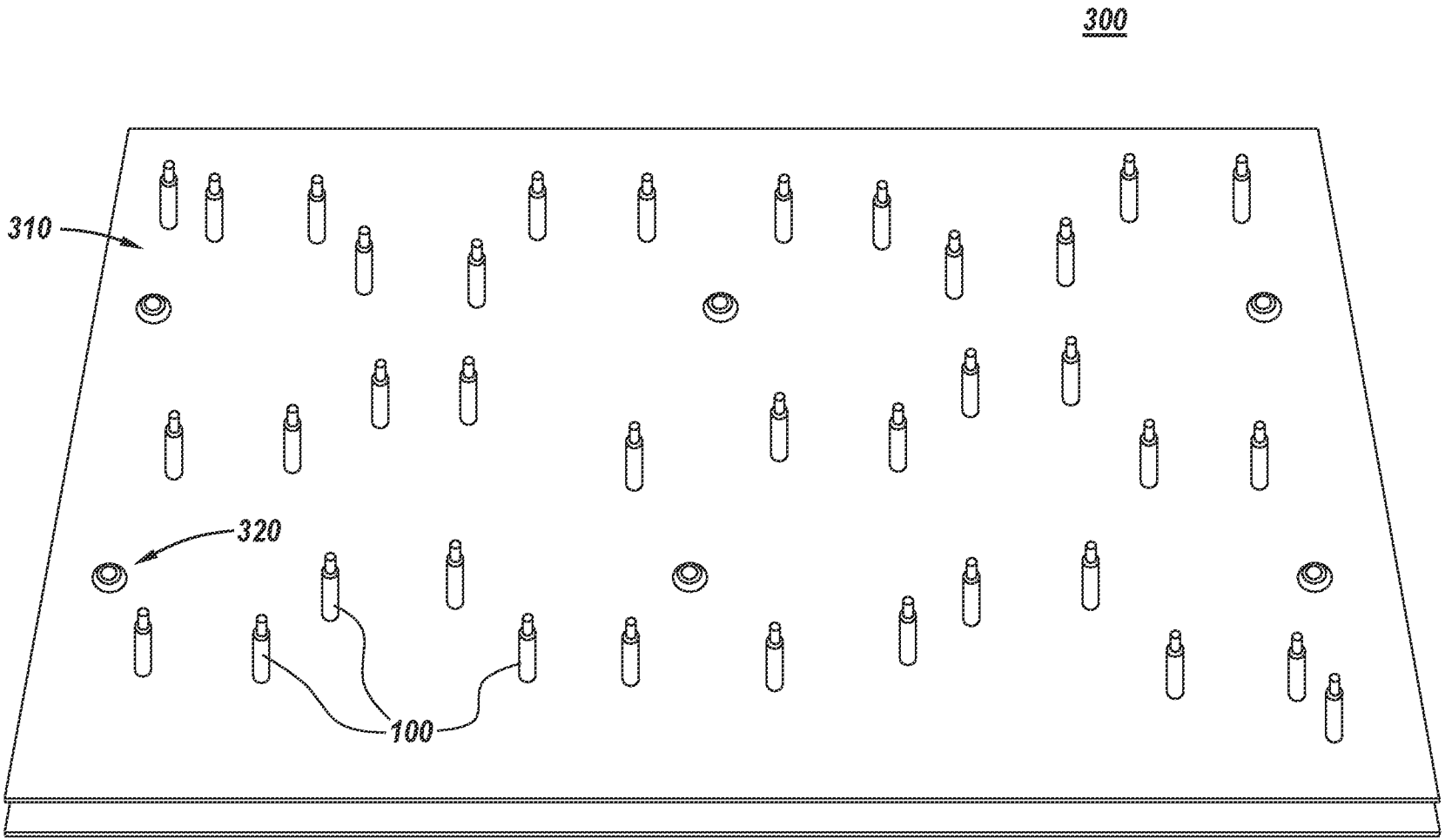
FIG. 3 is a perspective view of a multiple anvil fixture.

FIG. 3 illustrates a multiple anvil fixture 300. The multiple anvil fixture 300 comprises a plurality of anvils 100, engaged within a base 310. The base 310 and anvils 100 can be engaged through a threaded fit, adhesive, locking fit, or other acceptable means. In one embodiment the base 310 can have a plurality of holes 320 to receive the anvils 100. The plurality of anvils 100 may protrude through the plurality of holes 320, wherein at least a portion of the second structure 120 is below that of the base 310. In some embodiments the plurality of holes 320 have a threaded circumference. In other embodiments the plurality of holes 320 are formed as recesses within the base 310. In some embodiments when the plurality of holes 320 are formed as recesses, the inner circumference of the recess is threaded.

The second structure 120 may have a threaded base to engage the base 310. The second structure may also have a recessed portion of the outer such that a base 310 may engage with the recess.

The anvils 100 engaged with base 310 are oriented in the same direction. Although an engagement of the second structure 120 is shown, the first structure 110 can also be engaged with the base 310.

Figure 4:
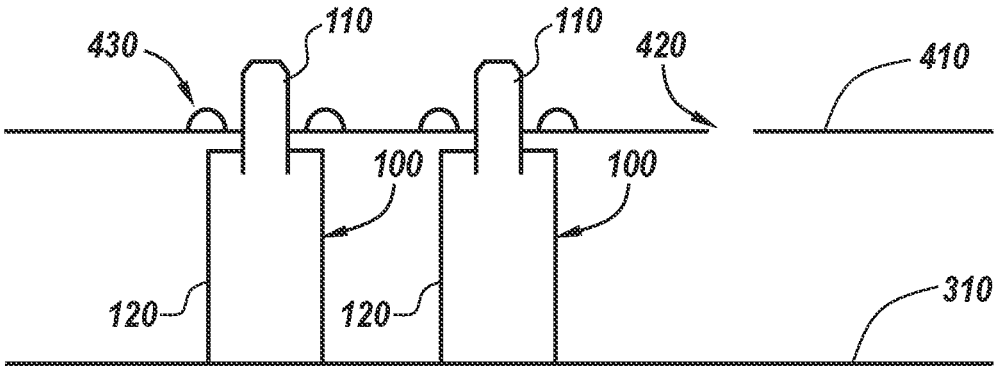
FIG. 4 is an illustration of a side view of a multiple anvil fixture illustrated in FIG. 3.

FIG. 4 illustrates an embodiment of a side view of the multiple anvil fixture 300. In one embodiment the multiple anvil fixture 300 includes a plate 410 which has a plurality of holes 420 such that the anvils 100 protrude through the holes. Each of the plurality of holes 420 may correspond to a location of an anvil 100 within the multiple anvil fixture 300. In some embodiments the plurality of holes 420 is greater than the number of anvils 100 in the multiple anvil fixture 300. In some embodiments the plate 410 provides rigidity to the multiple anvil fixture 300. In some embodiments the plate 410 provides a platform for other objects. In some embodiments the plate 410 rests on the second structure 120 such that the plurality of holes 420 allow the first structure 110 to protrude in a slidable relationship with the second structure 120. The plate 410 may be fixed to the base 310, clamping the anchors 100 into a fixed position.

A container to receive a plurality of rivets may be placed upon the plate 410. In some embodiments when the anvil 100 is in the recoiled position the first structure 110 of the anvil 100 protrudes from the plate 410. In other embodiments, the first structure 110 in the recoiled position may extend into the holes 420 in the plates 410 without protruding beyond the plate. In some embodiments, the plate 410 comprises a plurality of protrusions 430 near each of the plurality of holes 420 to create a small space between a top of the plate 410 and a bottom of a container placed upon the plate 410.

Figure 5:
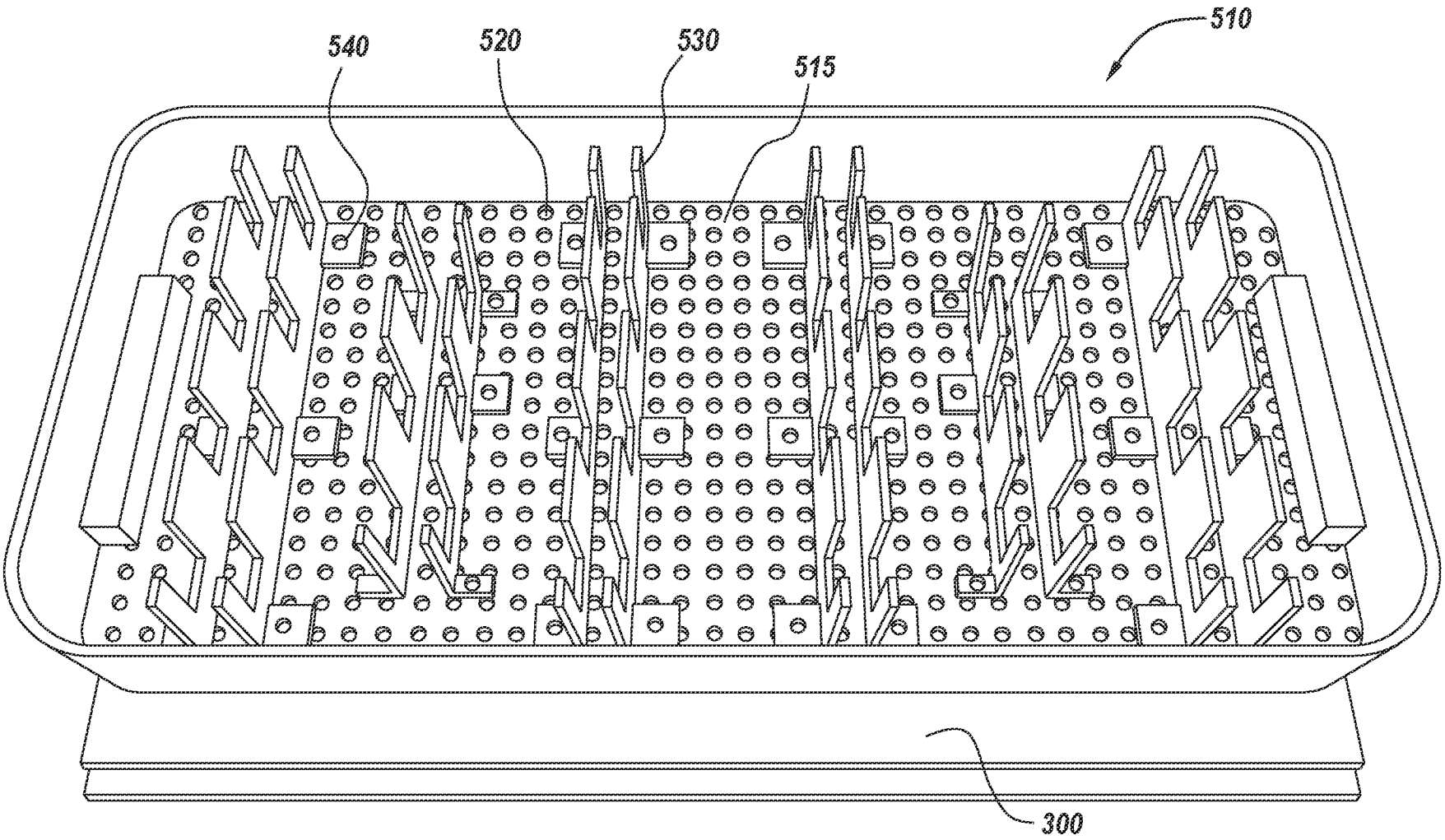
FIG. 5 is a perspective view of the multiple anvil fixture illustrated in FIG. 3 with a container.

FIG. 5 illustrates a container 510 containing a base 515, and brackets 530 with bracket openings 540 upon the multiple anvil fixture 300. The container 510 comprises openings 520, wherein the first structure 110 of anvil 100 (not shown in FIG. 5) of the multiple anvil fixture 300 protrudes through one of the openings 520, such that each anvil 100 within the fixture 300 protrudes through an opening 520. A bracket 530 containing a bracket opening 540 is placed on a respective anvil 100 of the fixture 300, such that the first structure 110 protrudes through the bracket opening 540. In some embodiments the container 510 is a sterilization tray, although the container 510 may be any appropriate container. Although the openings 520 are circular the openings 520 can be of any appropriate geometry for receiving a rivet.

Figure 6:
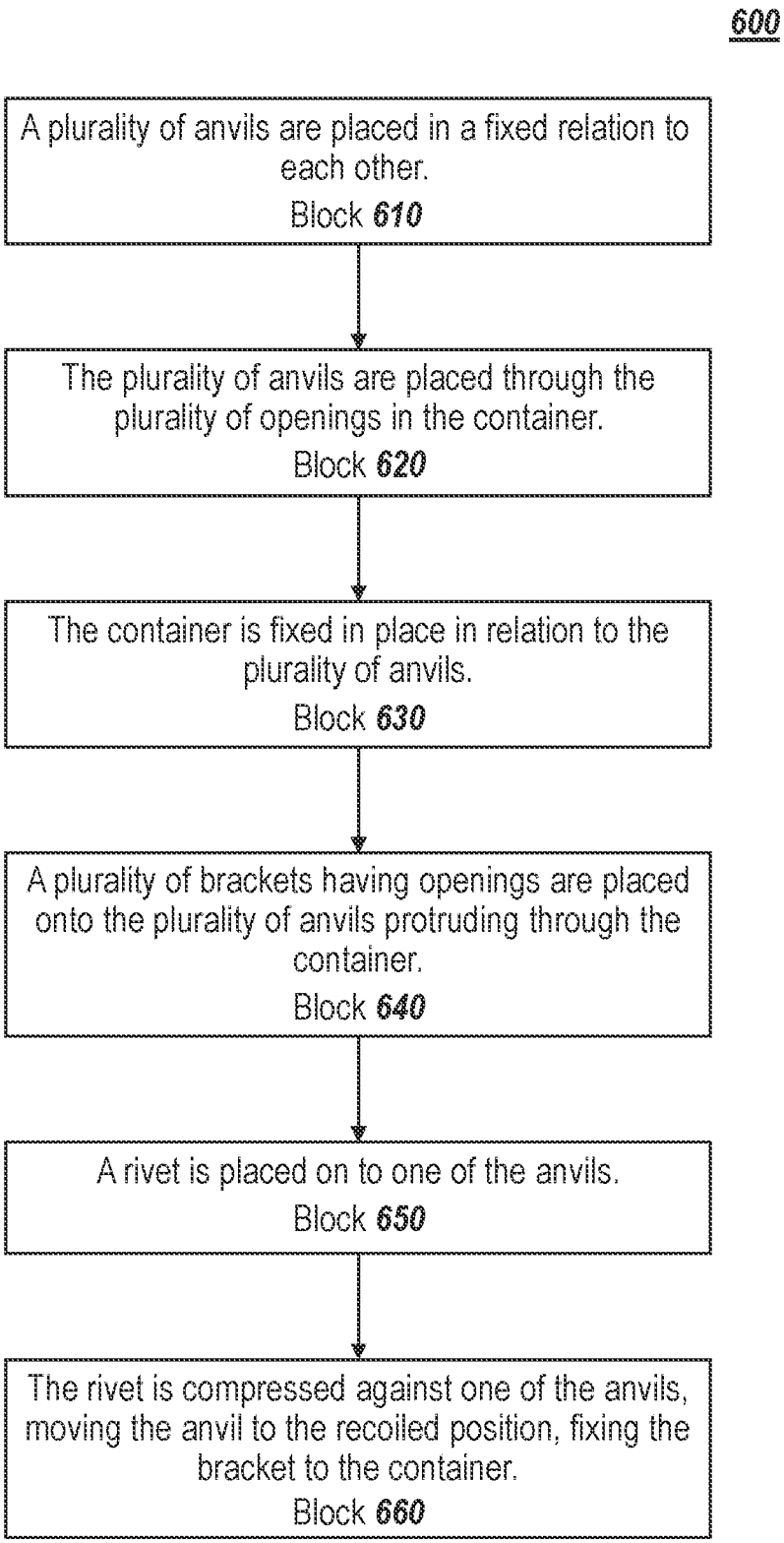
FIG. 6 is a flow chart illustrating a method of making a container with the multiple anvil fixture.

FIG. 6 illustrates a flow chart describing the method 600 for manufacturing a container 510. At step 610 a plurality of anvils 100 are placed in a fixed relation to each other. At step 620 the plurality of anvils 100 are placed through the plurality of openings 520 in the container 510. At 630 the container 510 is fixed in place in relation to the plurality of anvils 100. In some embodiments the container 510 is fixed via one or more clamps, wherein the clamp holds the container 510 to the base 310. At step 640 a plurality of brackets 530 having bracket openings 540 are placed onto the plurality of anvils 100 protruding through the container 510. At step 650 a rivet 710 is placed on to one of the anvils 100. At step 660 the rivet 710 is compressed against one of the anvils 100, moving the anvil 100 to the recoiled position, fixing the bracket 530 to the container 510.

Figure 7A:
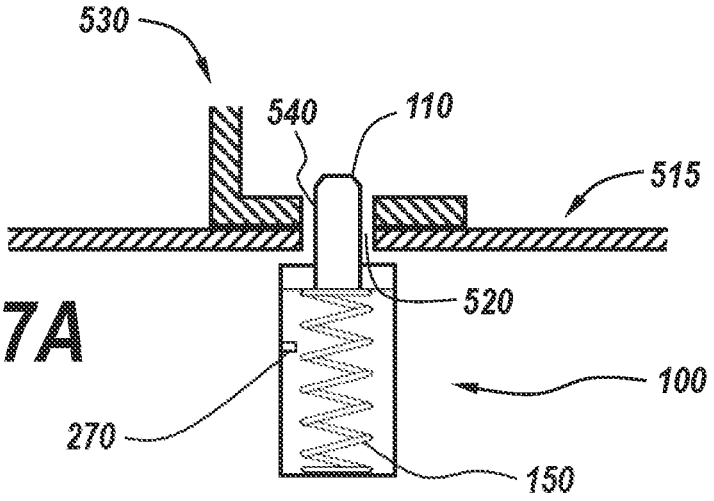
FIG. 7A is a cross-sectional side-view of an anvil in the extended position and a container at the beginning of the method illustrated in FIG. 6.
Figure 7B:
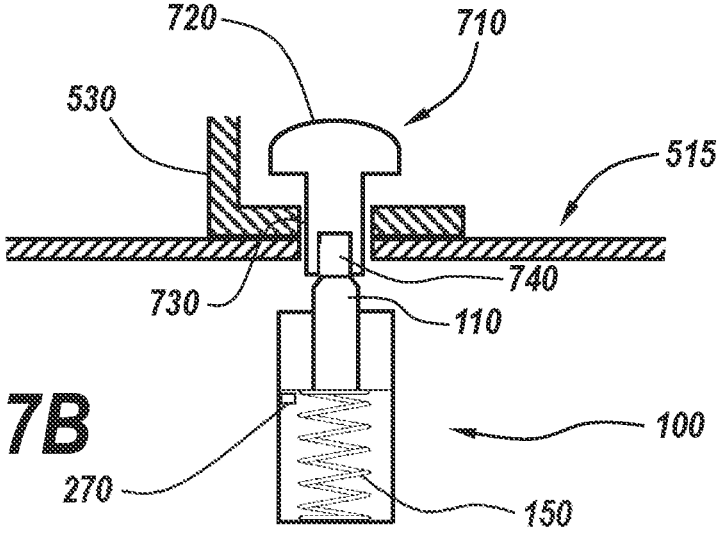
FIG. 7B is a cross-sectional side view of the container and the anvil of FIG. 7A in the recoiled position and a rivet at a second stage in the method illustrated in FIG. 6.
Figure 7C:
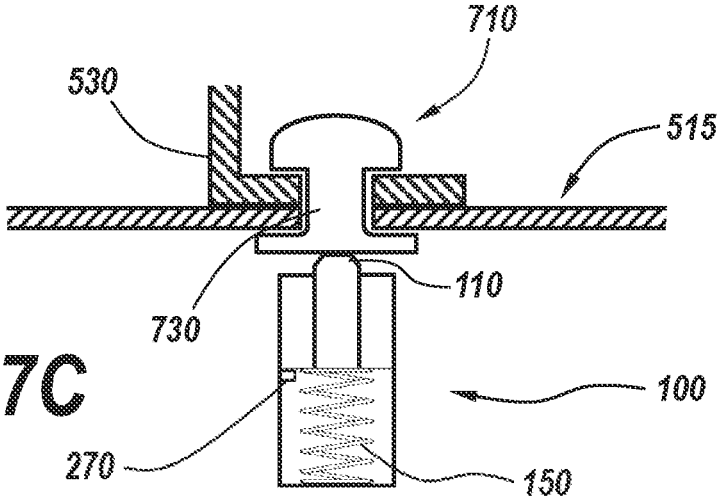
FIG. 7C is a cross-sectional side view of the container and the anvil of FIG. 7A in the recoiled position, and the rivet at a third stage in the method illustrated in FIG. 6.

FIG. 7A-7C illustrate the method of applying a rivet 710 to a container 510 using the multiple anvil fixture 300. FIG. 7A is a side view of a portion of the multiple anvil fixture 300, showing a single anvil 100 wherein the first structure 110 protrudes through an opening 520 in the base 515 of the container 510, and a bracket opening 540 in a base of the bracket 530. FIG. 7A illustrates an anvil 100 in the extended position, which is the position of each anvil 100 before a rivet 710 is fixed to the container 510.

FIG. 7B illustrates the application of rivet 710 to the container 510. The rivet 710 having a rivet top 720 and a shaft 730, wherein the shaft 730 has a hollow end 740. The shaft 730 is placed through the bracket opening 540 and the opening 520 in the container 510. The application of the rivet 710 causes the first structure 110 to slide into the recoiled position, wherein the first structure 110 is pressed into the recoiled position by the hollow end 740 of the shaft. When the first structure 110 reaches the recoiled position, it resists further downward motion and the application of further force on the rivet top 720 deforms the rivet 710 at the hollow end 740. The hollow end 740 of the rivet 710 spreads wide and fixes the bracket 530 to the container 510, as shown in FIG. 7C. Once the rivet 710 is fixed to the container 510, the anvil 100 remains in the recoiled position until the container 510 is lifted from the multiple anvil fixture 300.

The features and advantages described herein are not all-inclusive and, in particular, many additional features and advantages will be apparent to one of ordinary skill in the art in view of the present disclosure. Persons skilled in the relevant art can appreciate that many modifications and variations are possible in light of the above disclosure.

What is claimed is:

1. A multiple anvil fixture comprising:

a plurality of anvils each having a first structure and a corresponding second structure, each second structure comprising a respective outer surface, wherein the first structure slidably engages with the second structure, wherein the first structure slides between an extended position and a recoiled position relative to the second structure, wherein the first structure is configured to secure rivets to a workpiece wherein each of the plurality of anvils comprises a biasing-element, wherein the biasing-element biases the first structure relative to the second structure in the extended position;

a base engaged with the plurality of anvils, wherein the plurality of anvils are oriented in the same direction; and a plate, wherein the plate comprises a plurality of holes that are sized such that each first structure can protrude through a corresponding one of the plurality of holes and each second structure cannot protrude through the corresponding one of the plurality of holes.

2. The multiple anvil fixture of claim 1, wherein the biasing-element is a spring.

3. The multiple anvil fixture of claim 1, wherein the second structure comprises a hollow section and a base section.

4. The multiple anvil fixture of claim 3, wherein the biasing-element is fixed to the base section, and a proximate end of the first structure.

5. The multiple anvil fixture of claim 3, wherein the hollow section comprises a stop on an inner wall, wherein the stop extends inward into a slidable path of the first structure.

6. The multiple anvil fixture of claim 5 wherein the slidable path of the first structure is shorter than the first structure.

7. The multiple anvil fixture of claim 1, wherein the first structure comprises a first diameter, and the second structure comprises a second diameter, wherein the first diameter is smaller than the second diameter.

8. The multiple anvil fixture of claim 7, wherein the first structure comprises a first lip having a first lip diameter wherein the first lip diameter is larger than the first diameter and wherein the first lip is contained within the second structure.

9. The multiple anvil fixture of claim 8 wherein the second structure has a second lip having an opening diameter, such that the opening diameter is larger than the first diameter and smaller than the first lip diameter.

10. The multiple anvil fixture of claim 1, wherein the second structure supports the plate.

11. The multiple anvil fixture of claim 1, wherein the plate comprises a plurality of protrusions adjacent each of the plurality of holes.

12. The multiple anvil fixture of claim 10, wherein the first structure protrudes from the plate when the first structure is in both the extended position and the recoiled position.

* * * * *